US006444273B2

(12) United States Patent
Coulibaly et al.

(10) Patent No.: US 6,444,273 B2
(45) Date of Patent: Sep. 3, 2002

(54) METHOD FOR SETTING AUTOMATIC GUN TRIGGERING PARAMETERS IN AUTOMATED SPRAY COATING SYSTEMS

(75) Inventors: Eric Coulibaly, Elyria; Gene L. Todd, Vermillion, both of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/933,967

(22) Filed: Aug. 21, 2001

Related U.S. Application Data

(62) Division of application No. 09/302,100, filed on Apr. 29, 1999, now Pat. No. 6,296,708.

(51) Int. Cl.[7] ..... B05D 1/02
(52) U.S. Cl. ..... 427/477; 427/421; 427/424
(58) Field of Search ..... 427/8, 421, 424, 427/477, 479, 483; 118/671, 679, 681, 683, 684, 708, 712, 629, 308, 324

(56) References Cited

U.S. PATENT DOCUMENTS 5,056,462 A * 10/1991 Perkins et al.
5,718,767 A * 2/1998 Crum et al.
5,843,515 A * 12/1998 Crum et al.
5,847,963 A * 12/1998 Gaiski
5,905,651 A * 5/1999 Coulibaly et al.
6,120,604 A * 9/2000 Hawkins

* cited by examiner

*Primary Examiner*—Fred J. Parker
(74) *Attorney, Agent, or Firm*—Calfee, Halter & Griswold LLP

(57) ABSTRACT

A method for controlling triggering of spray guns in an automatic spray coating system, includes a hand-held pendant having input controls for entering spray gun "on" and spray gun "off" control parameters based upon observation of parts as they are conveyed past the spray guns by a conveyor. Gun triggering controls for optimized spray patterns, including extended and restricted spray patterns and combinations thereof, are entered and saved in a gun triggering controller according to an operator's inputs which include START SPRAY, STOP SPRAY, SAVE and SET PICKOFF controls. Multiple gun control parameters are stored as unique part coating recipes in the controller and are executable in look-ahead sequence based upon part identification as parts are conveyed toward the spray guns. The multiple gun control parameters are calculated by the controller from a fixed Pickoff distance from a part identification sensor to the spray guns.

14 Claims, 5 Drawing Sheets

D
1
P
2
Le
S
FES
EXTENDED SPRAY FES

Le
S
FES
RESTRICTED SPRAY FES

Le
BES
R
EXTENDED SPRAY BES

Le
BES
R
RESTRICTED SPRAY BES

PE
G

METHOD FOR SETTING AUTOMATIC GUN TRIGGERING PARAMETERS IN AUTOMATED SPRAY COATING SYSTEMS

This application is a divisional of U.S. application Ser. No. 09/302,100 filed on Apr. 29, 1999, now U.S. Pat. No. 6,296,708.

FIELD OF THE INVENTION

The present invention pertains generally to automated spray or coating systems such as powder or liquid coating systems and, more particularly, to control systems for controlling spray guns in automated coating systems.

BACKGROUND OF THE INVENTION

In automated coating systems, for example of the type having one or more controlled material application spray guns (such as powder spray guns) positioned adjacent to a conveyor which carries parts to be coated past the guns, the guns are controlled (turned on and off and in some cases moved relative to the parts) to apply an optimal spray pattern to parts. Whenever there is a gap between parts on the conveyor, the guns should be turned off to stop spraying in order to minimize waste of material such as powder coating material. The turning on and off of the guns is referred to as "gun triggering". Automatic gun triggering gives the ability to optimize material usage. Automatic gun triggering uses a set of adjustable parameters which allow each gun of an array to automatically and efficiently apply a coating material to the parts. The automatic gun triggering parameters specify when and for how long each gun will spray a specific part.

In prior art systems of this type, the setting of optimal gun triggering parameters is difficult. An initial activation of the gun or guns has conventionally been accomplished by use of a photoeye detector which "sees" a part as it passes by on the conveyor. The first spray gun of an array is located at a fixed point from the photoeye. Many variables must be accounted for in achieving optimum spray coating, such as part size and shape, rate of conveyance, and spacing between parts. In a straight, uncalibrated automatic spraying set-up, the guns are turned on precisely at the front edge of a part, and turned off precisely at the back edge. This type of gun control may not completely coat the front and back edges of the part. Therefore, the triggering of the gun may have to be controlled to turn on prior to arrival of the part, and to continue spraying after the part has passed for complete coating of the part. This is called an "extended wrap" pattern which starts spraying prior to arrival of the leading edge of a part, and continues spraying after the part has passed. The gun on and gun off signals must be separately determined for extended wrap patterns. For example, if the guns were set to turn on before arrival of a part, this could cause the guns to turn off prior to arrival of the trailing edge of the part at the gun. A "delay off" control is used for keeping the guns spraying until the trailing edge of the part has passed. In other gun triggering set-ups, it is desired to start spraying after the leading edge of the part has passed the gun. This is referred to as "restricted wrap" pattern. In this case, a "delay-on" control is required to prevent the gun from spraying at the leading edge of the part. In this case also, the total spray duration must be adjusted to account for the delay-on control.

Prior art systems therefore have required setting of three different gun triggering control parameters: Delay-off (for extended wrap), Delay-on (for restricted wrap), and a parameter known as the "Pickoff". The Pickoff is the parameter which determines when the gun will start spraying relative to the position of a part approaching the gun. The distance "D" is the distance from the photoeye to the gun. If the Pickoff is set to equal the distance "D" then the gun will start spraying exactly when the part reaches the gun (i.e., when a leading edge of the part is aligned with the gun). The gun will start spraying at the Pickoff point, and spray for the length of the part, i.e., for the amount of time it takes the part to pass the gun G. The length of the part is automatically detected as the part is carried through the photoeye on the conveyor and this information is input to the controller. If the Pickoff is set at less than the fixed distance D, and no adjustments are made, the gun would start spraying before the forward edge of the part passes the gun, spray for the length of the part and stop spraying before the part has passed the gun. If the Pickoff is set at greater than the distance "D", the gun will start spraying after the part reaches the gun, spray for the length of the part, and stop spraying after the rear edge of the part has passed the gun.

In the prior art, as schematically shown in FIG. 1, in order to spray a distance "X" before the part reaches the gun, and to continue spraying after the part has passed the gun for a distance "Y", the following setup is required:

Pickoff=D−X

Delay-on=0 (since this is an extended wrap pattern and Delay-on is only used for restricted wrap patterns)

Delay-off=X+Y

The Pickoff, the part position at which the gun will start spraying, (D−X) is less than the distance "D". The gun will start spraying the distance "X" before the leading edge le of the part reaches the gun. Spray continues for the distance X plus the length "P" of the part plus the distance Y after the trailing edge of the part passes the gun. Thus, the Delay-off is set at X+Y meaning the controller holds the guns open for the distance of X+Y conveyor movement in addition to the distance P which is the length of the part. To achieve this spray pattern, a D−X Pickoff value and X+Y Delay-off value are input to the controller.

One difficulty of this prior art gun triggering procedure lies in the fact that both the Pickoff and the Delay-off are functions of the same variable X. If there is a change in the distance "X", the distance in front of the part that the gun begins spraying, both the Pickoff and the Delay-off parameters must be adjusted and input again into the controller. The Pickoff and the Delay-off parameters are not independent.

A numerical example of a prior art spray pattern is also shown in FIG. 1. In a case where the system is to apply a coating to part P such as a flat panel which is 20 inches long, in order to coat the leading and trailing edges of the panel it is desired to start spraying 6 inches (of conveyor travel) before the leading edge le of the part P arrives at gun G, and to continue spraying for 4 inches (of conveyor travel) after the trailing edge te of the part passes gun G. This "extended wrap" spray pattern covers a total distance of 30 inches (6"+20"+4"). In other words, 30 inches of the conveyor on which the part is mounted passes the gun G during the spray period.

If the gun is set to start spraying 6" before the leading edge of the part reaches the gun G, the pickoff must be adjusted by subtracting 6" from the 100" distance D between the photoeye PE and gun G. Therefore, an "adjusted pickoff" of 96" (D−X) is input to the controller. To continue spraying for 4" after the part passes the gun, the "Delay-off" of 10" (6"+4") is also input to the controller. The length of the part P=20" is read by the photoeye as the part passes the photoeye and also input to the controller. When the leading edge of the part P is 6" from the gun, the gun will spray for 30" of conveyor travel (6"+20"+4"). The gun will stop spraying 4" after the trailing edge te of the part P passes the gun G.

If a change in the setup is made to spray, for example, 9" before the leading edge, and still 4" after the trailing edge, the length of spray before the leading edge must be changed, from 6" to 9". The Pickoff is set to start spraying 9" before the leading edge le of the part reaches the gun G. Therefore, 100"−9"=91" is now input to the controller as the Pickoff. The Delay-off value must also be adjusted to 9"+3"=12" and input into the controller. The part length of 20" is unchanged. With these new parameters, the gun will start spraying 9" before the leading edge of the part arrives at the gun and will spray continuously for 9"+20"+4"=33" of conveyor travel. Thus, to generate this new triggering pattern, the Pickoff must be adjusted and reinput as well as the Delay-off. This makes this triggering system difficult and time consuming to configure and re-configure especially for different types of parts combined on a single conveyor.

Another problem associated with automated spray systems of the prior art is the inability of the operator to watch the spraying operation to confirm proper coating coverage. This is because a stationary control panel is typically located adjacent to a spray booth wherein the spray guns are located. Ideally, an operator is able to observe parts as they pass through the booth past the guns to assess the pattern and extent of coating coverage. However, since the operator must remain at the control panel, in some installations it is difficult to see from the panel location the parts as they are coated. This makes it more difficult to properly set the spraying parameters.

SUMMARY OF THE INVENTION

The present invention overcomes these and other disadvantages and shortcomings of prior art systems. The invention provides an automated coating application system and method in which the spraying parameters for different spray patterns are independently adjusted by the user in order to rapidly and accurately configure the system for optimum coating of a succession of conveyed parts. The automatic gun triggering system of the invention has an automatic gun triggering set-up feature which allows the operator to easily and rapidly set the triggering of the spray guns, by directly observing the movement of parts past the spray guns. The gun triggering settings or parameters are input to a control system through a hand-held mobile pendant having START SPRAY, STOP SPRAY, SAVE and SET PICKOFF input controls.

The invention uses three independent spraying parameters: Pickoff, Front-Edge-Spray and Back-Edge Spray.

In the invention, the Pickoff is always a fixed distance "D" from the photoeye to the gun. Because the photoeye and gun locations are fixed, the Pickoff does not change. The Pickoff is set only once unless the gun or/and the photoeye are physically moved. For this reason, it is referred to as the "Permanent Pickoff".

The Front-Edge-Spray, if greater than zero, is the position of the front edge fe of the part before arriving at the gun, at which the gun starts spraying. If less than zero, the Front-Edge-Spray is the distance of travel of the front edgefe of the part past the gun, for which spray is withheld. If the Front-Edge-Spray is equal to zero, spray will start when the front edge fe is aligned with the gun.

The Back-Edge-Spray is the gun triggering parameter which determines when the gun will stop spraying relative to a position of the back edge of a part. If the Back-Edge-Spray is set at less than zero, the gun will stop spraying before the back edge of the part reaches the gun. If the Back-Edge-Spray is set at greater than zero, the gun will continue to spray after the back edge be of the part has passed the gun. If the Back-Edge-Spray is set at zero, the spray will stop when the back edge be is aligned with the gun.

In one example of the invention, described with reference to FIG. 2, in order to spray a distance "X" before the part reaches the gun (i.e., a "Front Edge Spray" or "FES"), plus spray for the length P of the part, plus spray a distance Y after the part passed the gun (i.e., a "Back-Edge-Spray" or "BES"), the following setup is required:

Pickoff=D

Front-Edge-Spray=X

Back-Edge-Spray=Y

The pickoff=D is fixed ("Permanent Pickoff"). The gun will start spraying at the distance "X" before the front edge fe of the part is aligned with the gun, spray for the length of the part P (as detected by a photoeye sensor), and spray a distance Y after the back edge be of the part P passes the gun. The Front-Edge-Spray distance "X", and the Back-Edge-Spray distance "Y", are set independent of each other, so that adjustment of one does not require a corresponding adjustment of the other. Stated in another way, because the Front-Edge-Spray X is not determined by an adjustment of the Pickoff, a change in the Front-Edge-Spray does not require a corresponding adjustment of the Back-Edge-Spray, as is required in prior art systems.

In accordance with one aspect of the invention, there is provided a system for automatically applying a coating such as a powder coating to a succession of parts, and an automated control system for controlling triggering of one or more spray guns for optimized coating of each part. The gun triggering control system has three control parameters, START SPRAY, STOP SPRAY, and SET PICKOFF for triggering the spray guns on and off relative to the operator observed passage of a part past the spray guns. The triggering control parameters, preferably input through a hand-held pendant, are stored in a programmable controller which controls the operation of the spray guns. Once the triggering parameters are set by operator inputs from the hand-held pendant, the system is ready to commence automatic spray coating of a series of parts carried by the conveyor. Multiple gun triggering control parameters can be entered into the system for parts of differing dimensions. A part identification sensor identifies parts prior to arrival at the spray guns and triggers the spray guns according to the parameters stored for the identified part.

In accordance with another aspect of the invention, there is provided an automated coating application system having one or more spray guns operative to spray a coating onto parts carried by a conveyor past the spray guns. A sensor such as a photoeye is operative to detect the presence and length of a part carried by the conveyor past the sensor. A spray gun control system has input controls which control triggering of the spray guns. The input controls are connected to a programmable controller operative to trigger the spray guns to on and off states corresponding to Front Edge Spray and Back Edge Spray gun control parameters input by an operator through the input controls. The parts conveyed past the guns are coated according to the Front Edge Spray and Back Edge Spray gun control parameters. A change in either the Front Edge Spray or Back Edge Spray triggering parameters does not require a corresponding change in the other.

In accordance with another aspect of the invention, there is provided a method of triggering one or more spray guns in an automatic spray coating system having at least one spray gun located proximate to a conveyor. Parts to be coated are conveyed past the spray gun by a conveyor. The spray gun is operatively connected to a coating supply, and to a spray gun triggering control system operative to turn the spray guns on and off according to gun triggering control parameters input by an operator to the control system. The system has a sensor for sensing the presence and length of a part conveyed by the conveyor, and a control input device having START SPRAY, STOP SPRAY, SAVE and SET PICKOFF input controls. The method includes the steps of: observing a part as it is conveyed by the conveyor up to and past at least one of the spray guns of the system; selectively triggering one of the spray guns to an "on" state by operation of the START SPRAY control of the control input device at a desired position of a front edge of the part relative to the spray gun to define a Front Edge Spray gun triggering control parameter; pressing the SET PICKOFF control when a front edge of the part is aligned with one of the spray guns, selectively triggering the spray gun to an off state by operation of the STOP control of the control input device at a desired position of a back edge of the part relative to the spray gun to define a Back Edge Spray gun triggering control parameter; storing the selected gun triggering parameters as a control recipe in the gun triggering control system by operation of the SAVE control; whereby a gun triggering control recipe is set for spraying the part conveyed by the conveyor according to the control recipe; and repeating this method for other parts input into the control system with other control recipes.

In accordance with another aspect of the invention, for automated spray coating arrangements which utilize a conveyor to convey parts past one or more spray guns for painting or coating, there is provided an automated method and system for determining spray gun triggering parameters based upon operator inputs according to observation of parts as they are conveyed past the guns. A sensor located proximate to a part conveyor senses the presence of a part, and records the front and back edges and length of the part in terms of encoder counts of conveyor movement. An operator presses a SET PICKOFF input control when the front edge of the part is aligned with the spray gun to provide a signal to the control system which indicates the distance from the sensor to the gun, referred to as a Permanent Pickoff. A START SPRAY input control is pressed when spraying is to commence, relative to a position of a part to the spray gun. A STOP SPRAY input control is pressed when spraying is to stop, relative to a position of the part to the spray gun. By the conveyor encoder counts, the system, determines a Front Edge Spray gun triggering control by subtracting the START SPRAY encoder value from the Permanent Pickoff. The system determines a Back Edge Spray gun triggering control by subtracting from the STOP SPRAY encoder count the length of the part and the Permanent Pickoff. By this method and system, the Front Edge Spray and Back Edge Spray gun triggering control parameters can be independently set and adjusted by observation by an operator, to provide an easy way of achieving any desired spray pattern.

These and other aspects of the invention are herein described in particular detail with reference to the accompanying Figures.

DETAILED DESCRIPTION OF PREFERRED AND ALTERNATE EMBODIMENTS

Figure 1:
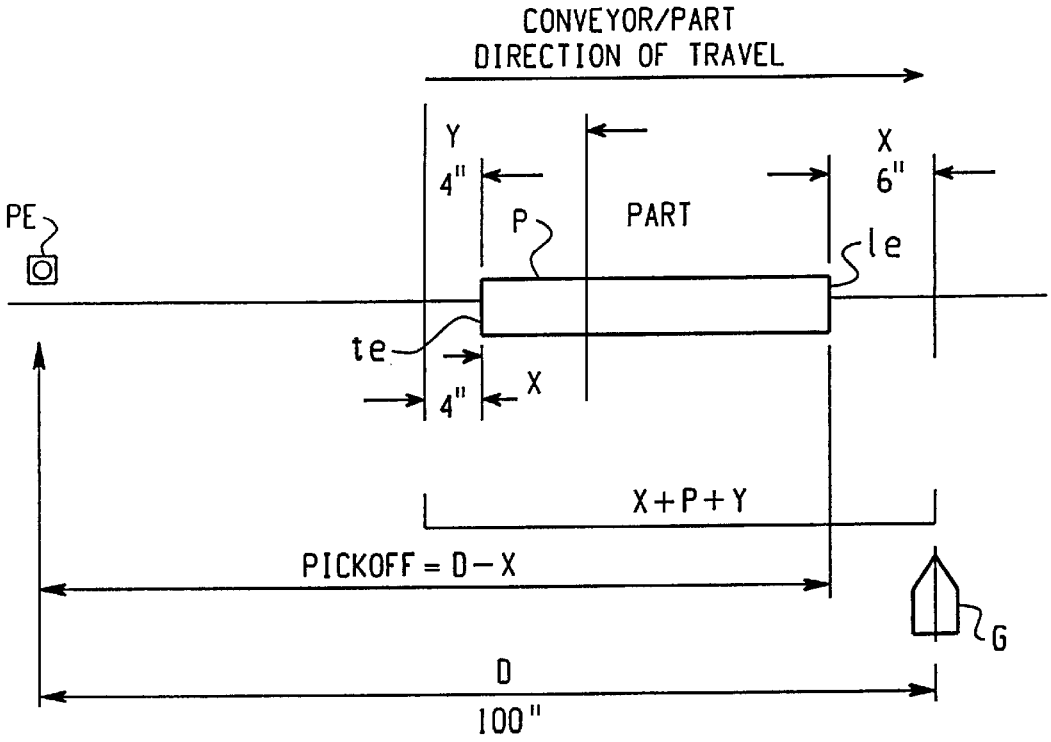
Fig. 1 (PRIOR ART)
FIG. 1 is a schematic diagram of the various parameters of an automated coating system operated in accordance with the gun triggering control systems and methods of the prior art.
Figure 2:
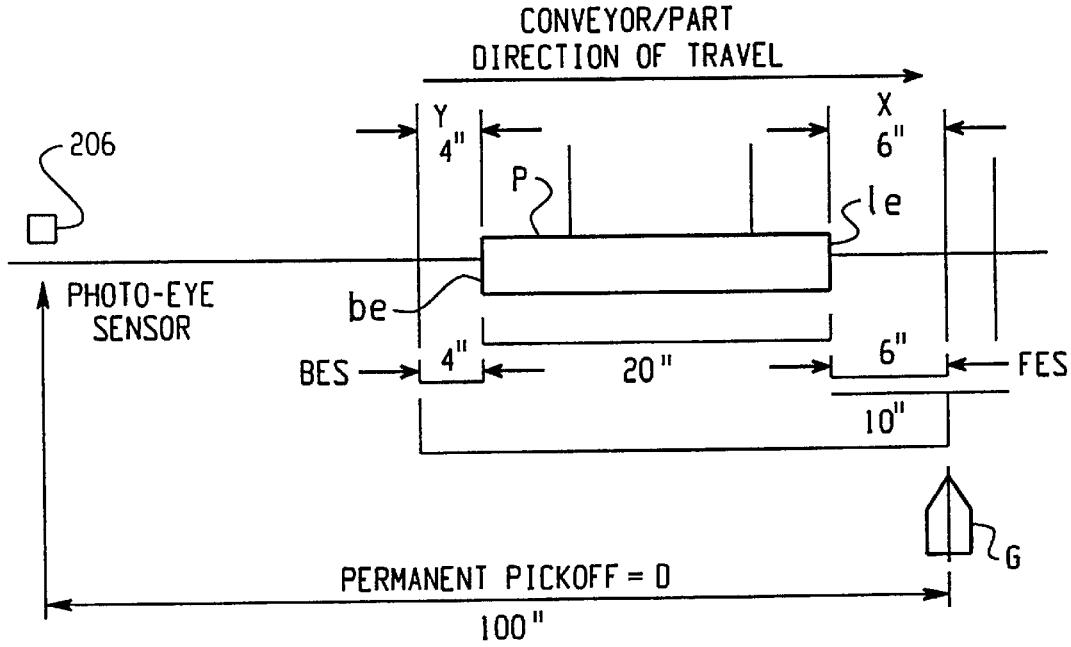
FIG. 2 is a schematic diagram of the various parameters of an automated coating system operated in accordance with the automatic gun triggering control systems and methods of the present invention.

With reference to FIG. 2, the system and method of the invention uses three parameters to establish an optimum spray pattern for any given part or series of parts. The parameters include: 1) a Permanent Pickoff distance D (e.g. 100") defined as the distance from a sensor 206 such as a photoeye to one of the spray guns G of a spray gun array of an automatic spray coating arrangement; 2) front edge spray (FES), which is the point at which the guns will start spraying relative to a front edge of the part; and 3) back edge spray (BES), which is the point at which the guns will stop spraying relative to a back edge of the part. The Permanent Pickoff distance D (also referred to as "Pickoff") is defined as the distance from the sensor 206 to the gun G, which may be, for example, the first gun of an array or bank of guns.

The FES is the distance at which the gun or guns start spraying before the front edge of the part arrives at the gun. An FES greater than zero will cause the gun(s) to start spraying before the front edge of the part. The greater the value of the FES, the earlier before the front edge of the part the gun will start spraying. An FES less than zero causes the gun(s) to start spraying after the front edge of the part has passed the gun (i.e., restricted spray). The more negative the value of the FES, the later the gun will start spraying after the front edge of the part passes the gun. An FES equal to zero causes the gun(s) to start spraying exactly at the front edge of the part.

The BES is the distance at which the gun or guns stop spraying relative to a position of the back edge of the part to the gun(s). A BES greater than zero causes the gun(s) to stop spraying after the back edge of the part has passed the gun. The greater the value of the BES, the later the guns will stop spraying after the passage of the back edge of the part past the gun(s). A BES less than zero causes the guns to stop spraying before the back edge of the part reaches the guns (i.e., restricted spray). The more negative the value of the BES, the earlier the guns will stop spraying before the back edge of the part passes the gun. A BES equal to zero causes the gun(s) to stop spraying exactly at the back edge of the part, i.e., when the back edge of the part is aligned with the gun(s).

FIG. 2 further shows the spraying parameters of a coating application example for a part P having a 20" length, wherein spraying is to start 6" (of conveyor travel) before the front edge fe of the part arrives at the gun G (FES), and to continue for 4" (of conveyor travel) after passage of the back edge be of the part passes the gun G (BES). This set of gun triggering parameters ensures that the front and back edges of the part P are adequately coated. This spray pattern is referred to as an extended wrap, and covers a total distance (or length of conveyor which passes the gun) of 30" (6" (FES)+20" (Part Length)+4" (BES)).

For the above example, the following three gun triggering control settings are made:

1. The Pickoff is set to cause the guns to theoretically start spraying exactly when the front edge of the part reaches the gun (100"). From this point, the gun will spray for 20" (i.e., 20" of conveyor passage) in that the photoeye has measured the length P of the part as 20".
2. The FES is set to cause the guns to actually start spraying 6" before the front edge of the part reaches the guns, i.e. FES=6".
3. The BES is set to cause the guns to actually stop spraying after the back edge of the part moves past the guns a distance of 4", i.e., BES=4".

This gun triggering setup will cause the guns to spray for a time duration equal to 30" of conveyor passage. Because the FES and BES settings are independent, an adjustment of one does not require adjustment of the other.

In the event a change to the triggering setup is desired to, for example, commence spraying 9" before the front edge and to stop spraying 4" after the back edge, the FES is the only data that is required to be changed (from 6" to 9"). The Pickoff is not changed. The FES is set by an operator to start spraying 9" before the front edge of the part arrives at the gun(s). The BES is not changed, and will to continue to cause the gun to spray for 4" of passage of the back edge be of the part past the gun. The new triggering setup, which required only a change of the FES, will cause the guns to spray for a duration equal in time to 33" (9"+20"+4") of conveyor passage.

Figure 3:
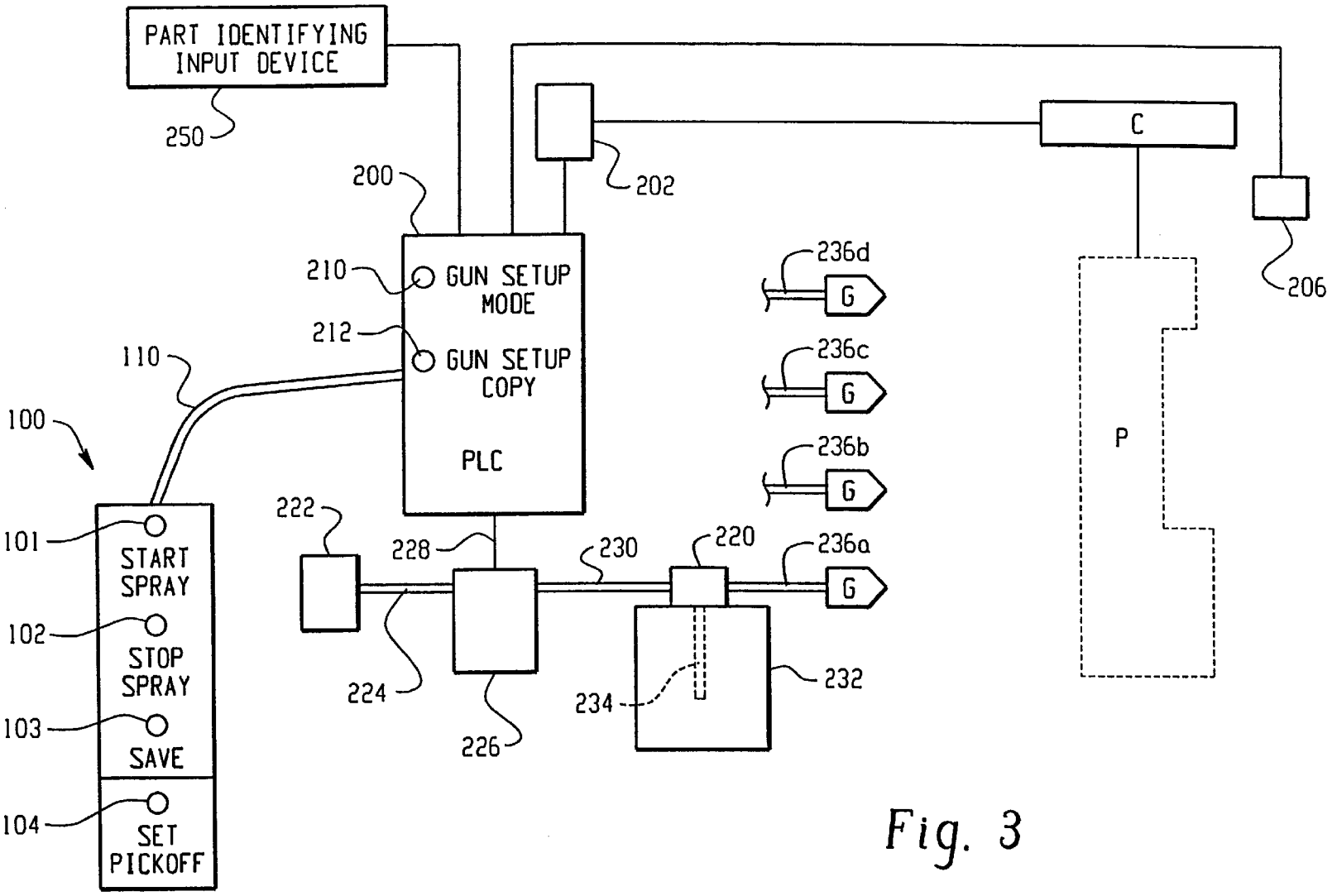
FIG. 3 is a schematic diagram of an automatic gun triggering control system of the present invention.

The invention further includes a feature for automatic setup of the gun triggering parameters. Instead of the trial and error setup procedures used in prior art systems, and the required mathematical calculation of new parameter settings every time the Pickoff was changed, the invention enables a user to set the spraying parameters based upon real-time observations of part conveyance past the gun(s). As shown in FIG. 3, the system includes an input control 100, which is preferably in the form of a hand-held pendant connected by electrical line 110 to controller 200. Pendant 100 preferably has a START SPRAY control 101, which triggers the gun(s) on to begin spraying coating material; a STOP SPRAY control 102 which triggers the gun(s) off, a SAVE control 103 which stores the START SPRAY and STOP SPRAY inputs in a controller as described below, and a SET PICKOFF control 104 which stores a Pickoff value in the controller. The input control 100 is preferably located or locatable proximate to the associated spray guns where an operator has a clear view of the coating operation of parts as they pass the spray guns.

In operation, typically to perform a system setup with an extended wrap spray pattern, an operator starts coating a part by pressing the START SPRAY control 101 as the part approaches the first gun and reaches the location where spraying should start, presses the SET PICKOFF control 104 when the front edge of the part is located at or aligned with the first gun, and turns the guns off by pressing the STOP SPRAY control 102 when the part reaches the location where spraying should stop. These visually determined gun triggering control parameters are input to a system controller 200 to which the pendant input control 100 is operatively connected. The controller 200 is, for example, a programmable logic controller having memory and signal generators operatively connected to gun triggering mechanisms 202 which control the ON/OFF state of guns G. In the case of a powder coating gun, the gun is turned ON when the pump 220 which feeds the gun G is turned on since there is no on/off valve in the gun itself. Powder is supplied to the gun as follows. A compressed air source 222 is connected by an air line 224 to a regulating device 226 such as a Nordson Corporation, Amherst, Ohio voltage to pressure regulator. An electrical line 228 from controller 200 provides a signal to regulating device 226 representative of the air flow to be supplied to pump 220 for the flow rate of powder to be delivered to gun G. In response to the signal on electrical line 228, regulating device 226 provides a compressed air flow through air line 230 to pump 220. The air flow through pump 220 creates suction force in the suction tube 234 which extends down into the fluidized powder feed hopper 232. This suction force pulls powder up the suction tube 234 into pump 220 and through hoses 236*a–d* to guns G. While the powder supply system for only gun G is shown in FIG. 3 for convenience, identical powder feed systems would be utilized for the remaining three guns shown in FIG. 3. Gun G is an electrostatic powder spray gun such as the Nordson Versa-Spray II gun which includes a power supply for electrostatically charging the powder sprayed from the gun.

In operation, when controller 200 initiates a signal to trigger gun G on an electrical signal will be sent through line 228 to regulating device 226 to allow air to pass from source 222 through air line 230 to pump 220 to pump powder through hose 236 to gun G. When spraying is to be terminated, a signal will be issued by controller 200 on line 228 to regulating device 226 to terminate the air flow on line 230 so that no powder is pumped to pump 220 to gun G.

Signals from an encoder 204, connected to the conveyor C, are input to controller 200 for synchronization of gun triggering controls with movement of part P by conveyor C. A sensor 206, such as a photoeye, is located proximate to conveyor C and parts P to sense the presence of and otherwise identify parts as they are conveyed past, and to measure the overall length of a part as a corresponding number of encoder pulses or counts.

A typical automatic setup sequence of the system using the input control pendant 100 is as follows.

1. The controller 200 is placed in a setup mode by pressing a GUN SETUP MODE button 210 on controller 200.
2. A conveyor C loaded with at least one part P is activated to carry the part toward the guns. The movement of the conveyor is encoded and signals of encoder 204 are sent to controller 200.
3. The START SPRAY control 101 is pressed when the le of the part is at a desired position relative to the gun(s), whereat the gun(s) is to be turned on. This input sets a FES value in controller 200.
4. The SET PICKOFF control 104 is depressed when the le of the part is positioned at the first gun. This sets the Pickoff value "D" in controller 200. The Pickoff value need be set only once for each fixed distance between the gun and the sensor. If either the guns or sensor are moved, a new Pickoff value is input to the system. The SET PICKOFF step can alternatively be performed by a second sensor operative to detect when the leading edge of a part is aligned with the first gun of an array.
5. The STOP SPRAY control 102 is depressed to turn the gun(s) off at a desired position of the back edge of the part relative to the gun(s), whereat the gun(s) is to be turned off. This sets the BES value in controller 200. Note that the STOP SPRAY location is actually the location of le when the back edge is at the appropriate position relative to the gun.

6. If the operator is satisfied with the coating results, the FES, Pickoff and BES settings are stored in the controller memory by pressing the SAVE control 103 on the pendant 100.

The above procedure establishes the triggering parameters for the particular part which is identified to the controller. In subsequent runs, the FES and BES settings can be modified, by operation of the START SPRAY and STOP SPRAY controls, as needed to extend or restrict the triggering pattern at the leading or back edges of the part, respectively. Alternatively, new FES, BES and Pickoff values can be changed through a key pad input. The Pickoff setting is not changed unless the physical distance between the photoeye sensor 206 and the gun G is changed. In a system with multiple guns, only the guns put in setup mode will spray during the test. Through the controller, a single gun or any combination of multiple guns can be setup and tested simultaneously. Operator set triggering parameters can be downloaded to a selected gun or guns at any time by pressing a GUN SETUP COPY control 212 on controller 200. The copy of the gun setup can be sent to any gun by specifying the gun number. After all the guns are set, the system is operated in an automatic mode to coat a series of parts in a production run.

The system uses the following formulas to compute the FES and BES:

FES=Pickoff−START SPRAY

BES=(STOP SPRAY−Part Length)−Pickoff

As a part passes in front of the sensor 206, the controller 200 tracks arrival of the front edge, and the length of the part which is stored in the controller memory. The SET PICKOFF control 104 is pressed when the front edge of the part is aligned with the first gun. This is the Pickoff setup portion of the method which is done only once for a particular run of parts. In the example of FIG. 2, the length of the part is 20" and the Pickoff is set at 100".

The FES and BES are setup based upon part geometry, spacing on the conveyor, conveyor speed, and coating requirements such as extended wrap or restricted spray, and ultimately by the operator's observation of the coating operation. The controller records a length of the part as detected by sensor 206. With a START SPRAY command entered at 6" prior to arrival of the front edge of the part at the gun(s), the front edge of the part has traveled 94" from the sensor 206 when it arrives at the START SPRAY (FES) point. With a STOP SPRAY command entered at 4" after the back edge of the part passes the gun(s), the distance traveled by the front edge of the part is 124" (i.e., 100"+20"+4"). The controller 200 thus computes the FES and BES as follows:

FES=Pickoff−START SPRAY=100−94=6"

BES=(STOP SPRAY−part length)−Pickoff=124−20−100=4"

If the FES computed is positive, it is the length of conveyor travel during which the gun sprays before the part reaches the gun. If the FES computed is negative, it is the length of the part which moves past the gun before the gun starts spraying. If the FES computed is zero, it means that the gun starts spraying exactly when the front edge of the part reaches the gun.

If the BES computed is positive, it is the length of conveyor travel during which the gun sprays after the part passes the gun. If the BES computed is negative, it is the length of the part not sprayed when the gun stops spraying. If the BES computed is zero, it means that the gun stops spraying exactly when the back edge of the part is aligned with the gun.

The system also includes a function for storing different part coating "recipes" which are then automatically executed as different types of parts are conveyed past the guns. Each recipe may have different gun triggering parameters, different FES and BES settings corresponding to different types of parts. The recipes are entered into the system in the manner previously described. A part identifying device 250 such as a bar code reading device can be used to identify each part with the gun triggering parameters, or recipe, entered into the controller for the part. Each different type of part to be coated is assigned a recipe number. The implementation of multiple part coating recipes does not require multiple Pickoffs to be calculated and input for each type of part. In the system, the Pickoff is a function of the location of the gun relative to the photo-eye and is not a parameter that is changed to achieve different spray patterns. Regardless of the type of part, the Pickoff is fixed. Therefore only the FES and BES are adjusted to accommodate different part types. The system thus expands the capability of setting up multiple recipes for gun triggering without the need for multiple Pickoffs to be calculated and input.

As parts are conveyed past the guns, the system determines the recipe (i.e. the triggering parameters) of the next part to be coated while coating the current part. When the back edge of the current part reaches the gun (at the Pickoff), the system loads the FES corresponding to the next part. At this point, the guns are still operating according to the BES control parameter for the current part. When the front edge of the next part reaches the gun (at the Pickoff), the BES for this next part (which is now the current part) is loaded. This "look ahead" cycle continues throughout a succession of parts which may be similar or dissimilar in shape and size.

If the BES of the current part and the FES of the next part overlap, the gun will continue to spray the entire gap between the current and the next part. An overlap occurs when the sum of the BES of the current part and the FES of the next part is greater than the gap between the current and the next part. In that case, the FES of the next part takes precedence over the BES of the current part. This of course is dependent upon the spacing of the parts on the conveyor. Other parameters related to the part type, such as the pump air pressure and the high gun voltage, can be loaded in the controller memory along with the FES and BES gun triggering parameters.

In one particular implementation, a shift register carries a snapshot of the part as it passes the sensor 206. For example, in the case where sensor 206 is a photoeye, the system records the length of time the photoeye is blocked by a passing part. The shift register is shifted every clock pulse generated by an encoder 204 which is operatively connected to the conveyor or conveyor drive as is known in the art. A set of pointers to the shift register accesses the information in the shift register as the part is carried by the conveyor. As explained above, the FES and the BES can be negative or positive. Each pointer sets a target spray pattern in the shift register.

Figure 4:
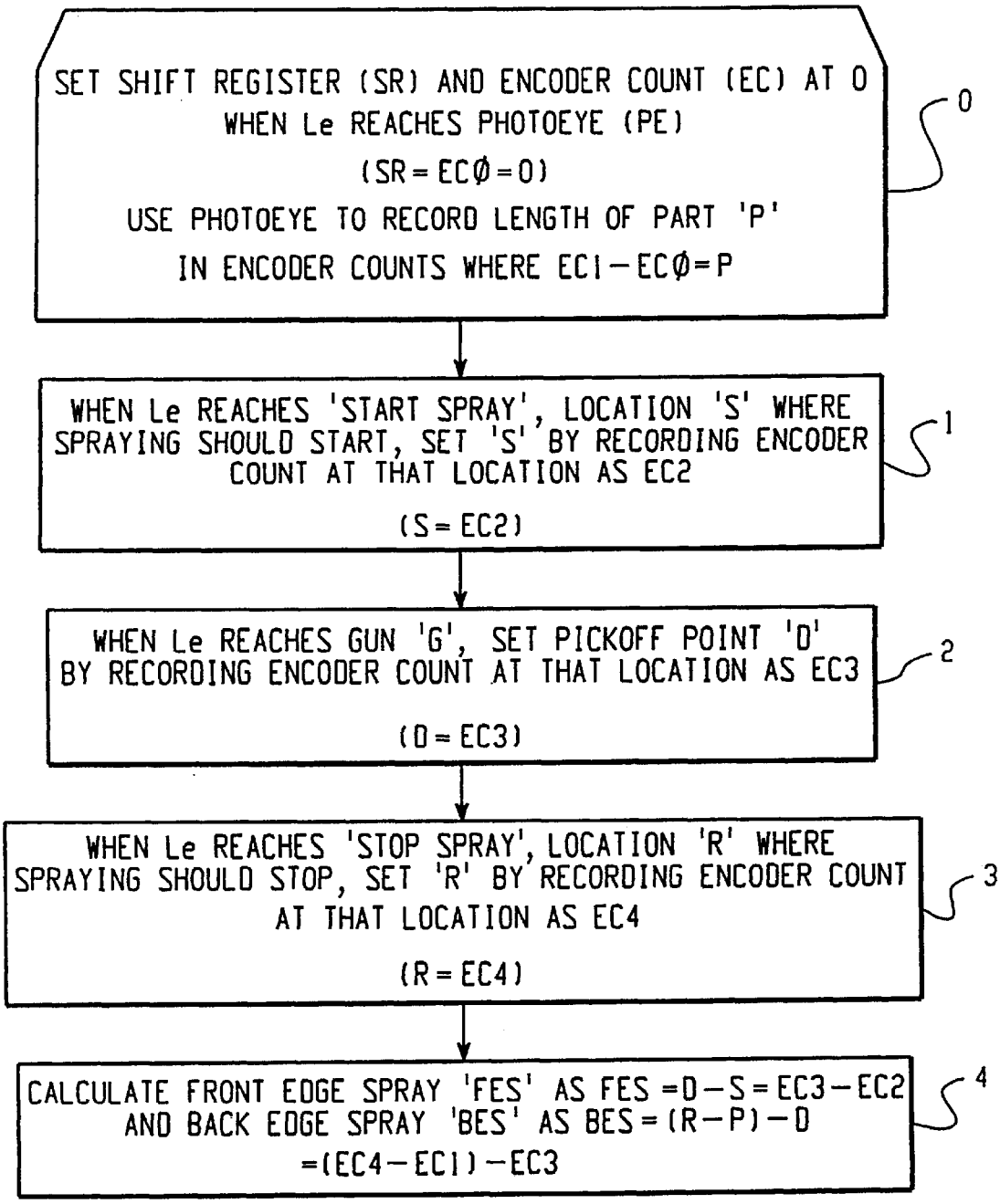
FIG. 4 is a flow chart of a method for controlling an automated spray coating system.
Figure 5:
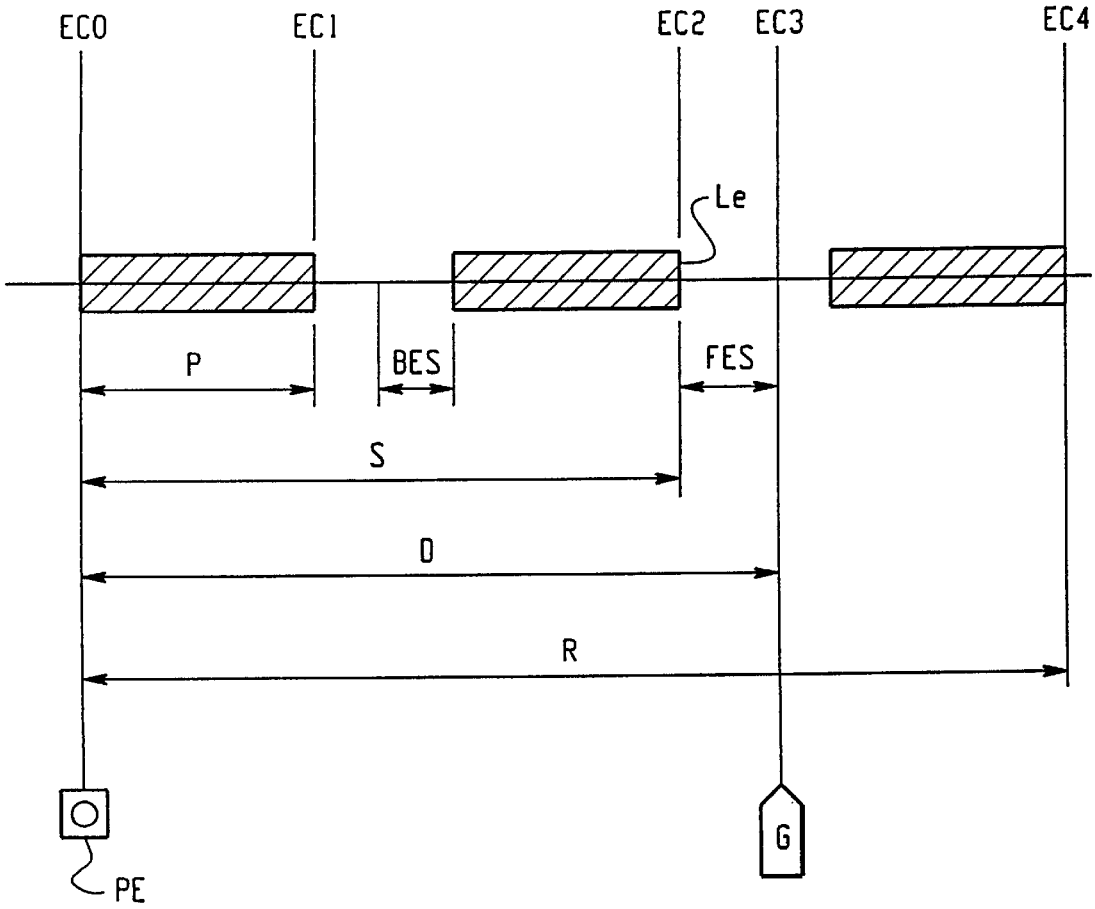
FIG. 5 is a schematic diagram of a part P at various positions in an automated spray system.

FIGS. 4 and 5 illustrate a method for converting operator inputs of START, STOP, SAVE and SET PICKOFF, into gun triggering control parameters. The method enables an operator, who is observing the passage of a part past a spray gun, to set the START SPRAY point by pressing the START SPRAY control at a desired position of the front edge of the part relative to the gun, to set the Pickoff by pressing the SET PICKOFF control when the front edge of the part is aligned with the gun, and to set the STOP SPRAY point by pressing the STOP SPRAY control at a desired position of the rear edge of the part relative to the gun.

At Step 0 the length of the part is measured as follows: Shift register SR(1) is set to shift for every encoder pulse. When the leading edge "Le" of a part is at the photo eye, the encoder count at that location ECϕ is set at zero. The value of the count is incremented every encoder pulse as the conveyor moves. When the trailing edge of the part passes the photo eye, the location of Le is registered as the encoder count ECI and the length of the part is calculated as P=EC1-ECϕ.

At Step 1, the START SPRAY button is pressed at a desired position "S" of Le to the gun. The encoder count EC2 corresponding to this location is registered as S=EC2.

At Step 2 the SET PICKOFF button is pressed when Le is aligned with the spray gun. The encoder count EC3 corresponding to this location is registered as Pickoff point "D"=EC3.

At Step 3, the STOP SPRAY button is pressed when the rear edge of the part is at the desired position relative to the gun, but which is recorded as the position "R" of Le relative to the gun. The encoder count EC4 corresponding to this location is registered as R=EC4.

At Step 4, the front edge spray (FES) is calculated as D−S or EC3−EC2. Back edge spray (BES) is calculated as (R−P)−D or (EC4−EC1)−EC3.

The Pickoff point D and part length P are constants. Therefore if a change to the FES is input into the system, the system can automatically calculate a new location S, in encoder counts, where spraying will start. Likewise, if a change to BES is input into the system, the system will automatically calculate a new location R, in encoder counts, where spraying will end. Consequently, unlike the prior art systems, FES and BES can be independently adjusted, which greatly simplifies operation of the system, especially where various sized and shaped parts are coated on the same line.

Figures 6A, 6B, 6C, 6D:
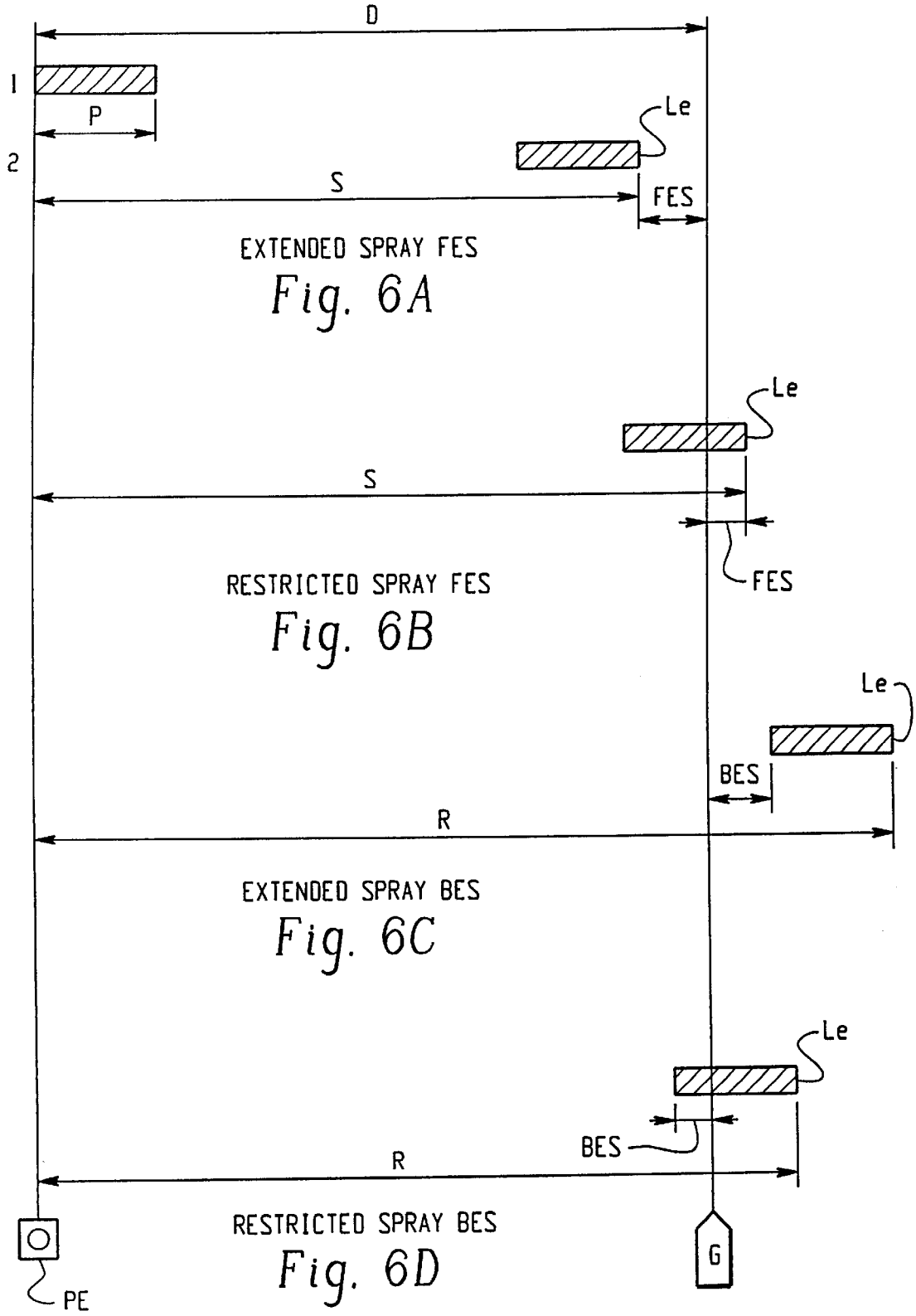
FIGS. 6A–6D are schematic diagrams of a part P at various positions in an automated spray system programmable to apply different spray patterns.

The system enables independent settings of FES and BES, for any combination of extended or restricted spray patterns, by tracking the part as it travels past the gun. As shown in FIG. 6A, the part length P is determined as the number of conveyor encoder counts during which the part is in front of the photoeye PE. The fixed distance D from the photoeye PE to the gun G is known. In an extended spray pattern, the START SPRAY part position S is determined as the difference D−FES. The distance FES is then added to the total spray duration so that the gun will spray for the total length of the part.

FIG. 6B illustrates the front edge spray (FES) in a restricted spray pattern wherein the START SPRAY part position S of Le is beyond the distance D from the photoeye PE to the gun G, resulting in a negative FES value which is subtracted from the distance D (D−(−FES)) so that in this case the gun does not spray for the total length of the part.

FIG. 6C illustrates an extended back edge spray (BES) pattern in which the STOP SPRAY point R is a distance BES beyond the fixed distance D. The BES spray control parameter is measured from the back or trailing edge of the part, so in the case of extended BES it is a value which is added to the total spray duration.

FIG. 6D illustrates a restricted BES in which spraying stops prior to complete passage of the part past the gun G, requiring a negative BES value which is subtracted from the total spray duration.

The real-time operator controlled methodology of setting the gun triggering control parameters using a hand held pendant enables easy and accurate setup of an automated spray coating system. The system operator can quickly switch from an extended spray pattern to a restricted spray pattern, or a combination of patterns for different types of parts. The FES is used to add or subtract spray distance at the front edge of the part. The BES is used to add or subtract spray distance at the back edge of the part. The Pickoff is set once and will only change if the gun or photoeye is moved. In practice, only the FES and the BES are used to tailor the spray patterns to each part.

Although the invention has been shown and described with respect to a particular preferred embodiment in a powder coating operation, it is equally applicable to a liquid painting operation, and it will be appreciated that the basic concepts of the invention are applicable to other types of spray gun control systems which may not be identical to those described here. Also, certain modifications and alterations may be made to the described system and method which may nonetheless fall within the scope of the invention as defined by the accompanying claims.

The invention claimed is:

1. A method of triggering one or more spray guns in an automatic spray coating system having at least one spray gun located proximate to a conveyor on which a part to be coated is conveyed past the spray gun, the method comprising the steps of:

sensing a location of said part as it is conveyed on the conveyor relative to a reference point, determining a first distance of said part at a start spray position relative to said reference point;

determining a second distance of said part at a stop spray position relative to said reference point;

determining a front edge spray gun control parameter by combining said first distance with a pickoff distance, said pickoff distance being defined as the distance from the gun to the sensor;

determining a back edge spray gun control parameter by combining said second distance with said pickoff distance and a length of said part; and automatically coating said part conveyed past the spray gun according to the front edge spray and the back edge spray gun triggering control parameters.

2. The method of claim 1 further comprising the steps of:

selectively setting a part location at which a leading edge of the part is generally aligned with the spray gun to define a Pickoff gun triggering control parameter by operation of a SET PICKOFF input control of the control input device, and storing the selected gun triggering control parameter in the control system by operation of a SAVE input control of the control input device.

3. The method of claim 2 further comprising the steps of selectively entering multiple gun triggering control parameters to define multiple control recipes for different types of parts, and storing the multiple gun triggering control parameters in the control system, and wherein more than one gun triggering control uses the same PICKOFF input control.

4. The method of claim 3 further comprising the steps of assigning a recipe number to each of the control recipes stored in the control system, and coating parts identified by the system according to recipe numbers which correspond to identified parts.

5. The method of claim 2 wherein the front edge spray gun control parameter is determined by subtracting the first signal from the pickoff distance.

6. The method of claim 2 wherein the back edge spray gun control parameter is determined by subtracting the length of said part from the second distance, and subtracting the pickoff distance from the difference of the length of said part subtracted from the second distance.

7. The method of claim 4 further comprising the step of loading a part coating recipe for a subsequent part during coating of a preceding part.

8. The method of claim 1 further comprising the step of associating pressure and voltage parameters with a gun control parameter.

9. The method of claim 1 wherein selected gun triggering control parameters are stored for operation of selected guns of an automatic spray coating system.

10. The method of claim 3 including the step of copying control recipes for execution by selected spray guns of an automatic spray coating system.

11. A method for determining gun control triggering parameters for initiating and terminating coating material through a spray gun onto an article to be coated, the method comprising the following steps:

sensing the location of said article relative to a reference point;

determining a first distance of said article at a start spray position relative to said reference point, and determining a second distance of said article at a stop spray position relative to said reference point;

determining a front edge spray gun control parameter by combining said first distance with a pickoff distance, said pickoff distance being defined as the distance from the gun to the sensor;

determining a back edge spray gun control parameter by combining said second distance with said pickoff distance and a length of said article to be coated.

12. The method of claim 11 wherein said front edge spray gun control parameter and said back edge spray gun control parameter are independent of each other.

13. The method of claim 11 wherein said first and second distances are independent of each other.

14. The method of claim 11 wherein said reference point is said spray gun.

* * * * *